United States Patent [19]

Burns, Jr. et al.

[11] Patent Number: 4,699,668

[45] **Date of Patent: * Oct. 13, 1987**

[54] METHOD AND APPARATUS FOR CLEANING GRIPPER ASSEMBLIES

[75] Inventors: William P. Burns, Jr., 5944 Clarendon Hills Rd., Clarendon Hills, Ill. 60514; John A. Stout, Jr., Oak Park; Clifford E. Cox, Chicago, both of Ill.

[73] Assignee: William P. Burns, Jr., Clarendon Hills, Ill.

[ * ] Notice: The portion of the term of this patent subsequent to Sep. 10, 2002 has been disclaimed.

[21] Appl. No.: 743,515

[22] Filed: Jun. 11, 1985

Related U.S. Application Data

[63] Continuation-in-part of Ser. No. 625,316, Jun. 27, 1984, Pat. No. 4,540,445.

[51] Int. Cl.[4] ..... B08B 3/00; B08D 3/04

[52] U.S. Cl. ..... 134/26; 15/318; 101/424; 101/425

[58] Field of Search ..... 134/21, 30, 26, 101; 15/318, 302, 316 R, 316 A; 101/424, 425

[56] References Cited

U.S. PATENT DOCUMENTS

| | | | |
|---|---|---|---|
| 3,355,324 | 11/1967 | Catzen | 101/424 |
| 4,456,022 | 11/1984 | Roberts | 134/153 |
| 4,540,445 | 9/1985 | Burns, Jr. | 134/30 |
| 4,549,562 | 10/1985 | Ossi | 134/153 |

*Primary Examiner*—Andrew H. Metz
*Assistant Examiner*—Sharon T. Cohen
*Attorney, Agent, or Firm*—Fitch, Even, Tabin & Flannery

[57] ABSTRACT

A portable containment structure is employed to clean a gripper assembly.

12 Claims, 5 Drawing Figures

FIG. 1
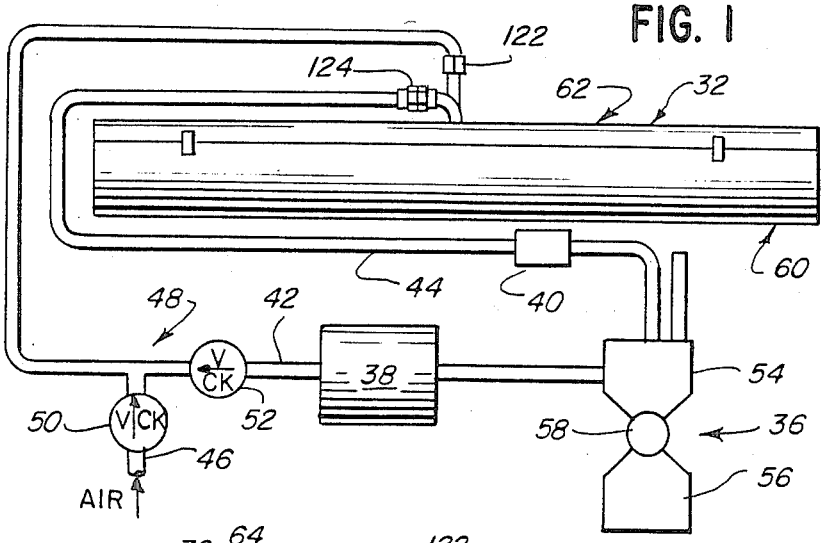
FIG. 2
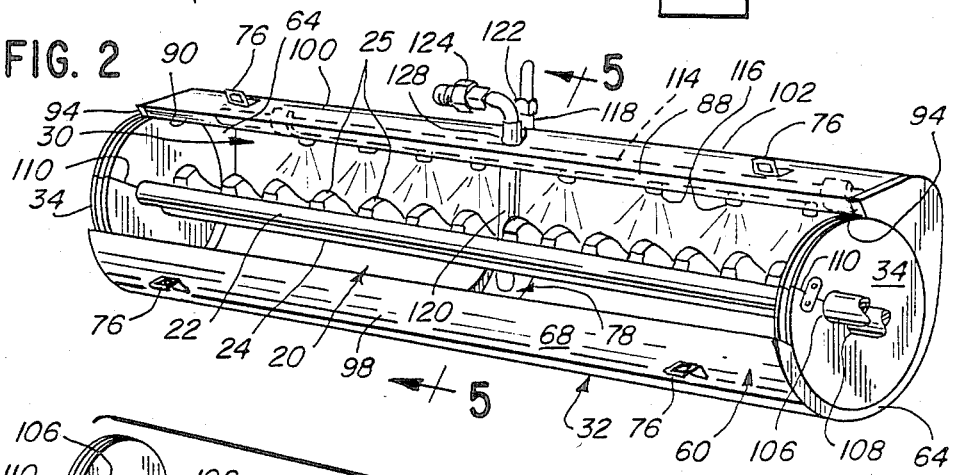
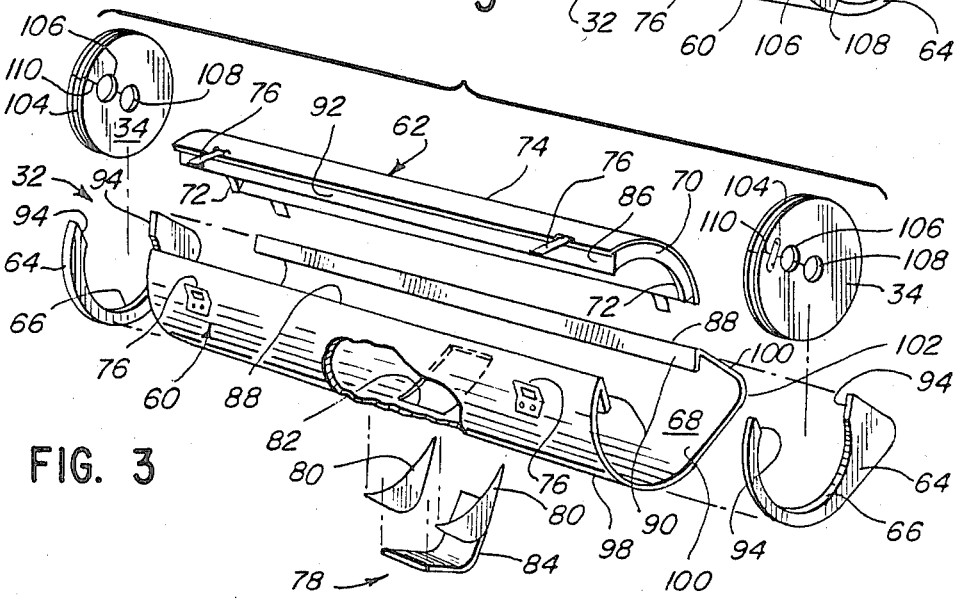
FIG. 3

FIG. 4
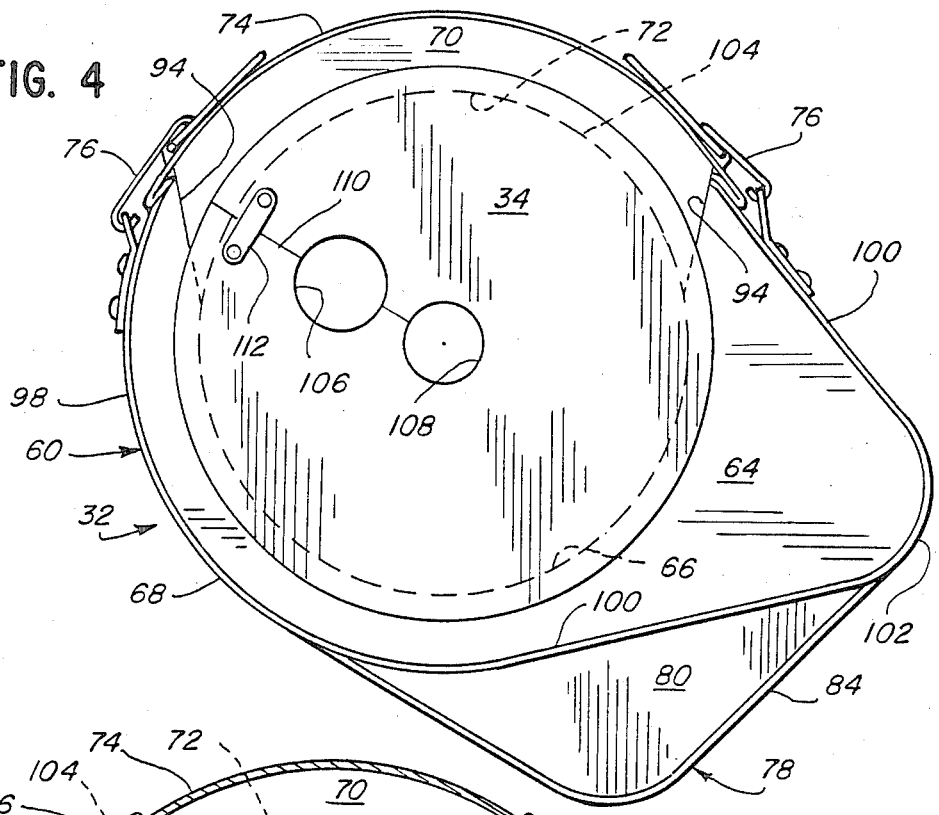
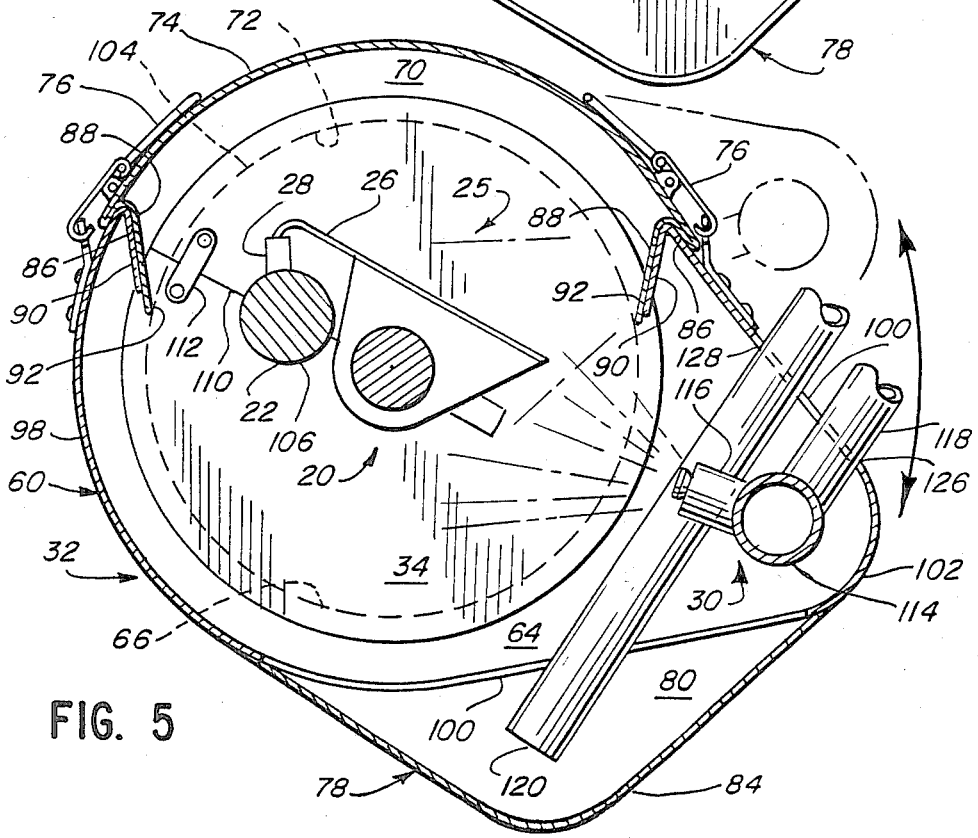
FIG. 5

METHOD AND APPARATUS FOR CLEANING GRIPPER ASSEMBLIES

BACKGROUND OF THE INVENTION

This is a continuation in part of Ser. No. 625,316, filed June 27, 1984, now U.S. Pat. No. 4,540,445.

The present invention relates generally to printing apparatus and more particularly to a method and apparatus for cleaning gripper assemblies on printing presses.

A continuing problem in the operation of printing presses having gripper assemblies thereon is that paper lint and other particulate matter may collect on the gripper assemblies. One example of such particulate matter is powder which is sprayed onto freshly printed sheets so that when the sheets are stacked they are separated from one another by very thin layers of powder. Accumulation of powder, paper lint and the like is undesirable because small amounts of such matter may fall from the gripper assembly onto printed sheets, staining the sheets. Also, accumulation of such matter may interfere with opening and closing of the grippers.

In the past, deposits of such matter on gripper assemblies have generally been removed by directing pressurized air at the grippers to blow the matter off of them or by using a small broom or the like to brush it away. Neither of these methods has been satisfactory. With either of these methods, some of the powder removed from the grippers typically becomes suspended in the air and may settle on adjacent presses or other equipment. Cleaning with a brush is very time consuming. Cleaning with compressed air is messy, as particulate matter may be blown over a wide area.

Another approach has been to manually spray the grippers with a lubricating solution which cleans and lubricates the grippers simultaneously. However, such spraying has been unsatisfactory for several reasons. First, use of such spray contaminates the surrounding environment, and commercially available lubricants which have been used in the past have been found to leave unpleasant odors after cleaning. A second problem is that the configuration of the press may restrict access to certain parts of the gripper assembly. Thus, it may be difficult to position a spray unit or hose in an orientation to direct the spray at all parts of the grippers, and it may be difficult for the person cleaning the grippers to see the parts being cleaned. A third problem is that manual spraying typically leaves excess lubricant on the grippers, and such excess lubricant tends to collect powder, paper lint and/or other particulate matter during operation of the press.

SUMMARY OF THE INVENTION

In accordance with the present invention, there are provided a novel method and apparatus for cleaning gripper assemblies wherein the grippers are enclosed by a containment structure and cleaned by a spray of cleaning fluid. The cleaning fluid is preferably directed at the grippers by a plurality of spray nozzles. A drain is preferably provided to enable continuous removal of fluid from the containment structure during cleaning. The structure is configured to facilitate placement thereof over the grippers in sealing cooperation with surfaces on the press adjacent the gripper assembly.

To enable the grippers to be lubricated as they are cleaned, the cleaning fluid preferably comprises a solution comprising a carrier which evaporates after the solution has been sprayed on the gripper assembly, and a lubricant which remains on the gripper assembly after the spraying operation. To remove loose particulate matter from the grippers, air may be blown over the gripper assembly within the containment structure prior to the spraying operation. Also, to remove excess cleaning fluid from the grippers after spraying and to aid in evaporation of the carrier, air is preferably blown over the gripper assembly after the spraying operation has been completed.

Accordingly, it is a general object of the present invention to provide a novel method and apparatus for cleaning gripper assemblies.

It is a further object of the present invention to provide a method and apparatus for removing particulate material from gripper assemblies on printing presses and containing the material removed from the grippers so that it does not contaminate the surrounding environment.

Further objects and features of the present invention are disclosed in the following description and the accompanying drawings.

BRIEF DESCRIPTION OF THE DRAWINGS

FIG. 1 is a diagrammatic view of a gripper cleaning system in accordance with one embodiment of the present invention.

FIG. 2 is a perspective view of a portion of the gripper cleaning system of FIG. 1, shown in installed relation on a gripper assembly.

FIG. 3 is an exploded perspective view of a containment structure and support members in accordance with the present invention.

FIG. 4 is an end view of the apparatus of FIG. 2, shown on an enlarged scale.

FIG. 5 is a sectional view taken substantially along line 5—5 in FIG. 2, shown on an enlarged scale, and having a rotated position illustrated in phantom.

DETAILED DESCRIPTION OF THE PREFERRED EMBODIMENT

The present invention is generally embodied in a method and apparatus for cleaning gripper assemblies on printing presses. Referring particularly to FIG. 2, there is shown a gripper assembly 20 comprising first and second generally horizontal support bars 22 and 24, each having a row of grippers 25 mounted thereon. Each gripper 25 includes a gripper finger 26 and gripper pad 28.

In the past, cleaning of such gripper assemblies has generally been accomplished by manually brushing the grippers, or by directing high pressure air at the grippers to blow particulate matter therefrom.

In accordance with the present invention, a method and apparatus are provided to enable gripper assemblies 20 to be cleaned by spraying cleaning fluid or solvent on the grippers 25 while containing the cleaning fluid and material removed from the grippers 25 to prevent contamination of the surrounding environment. The cleaning fluid is preferably directed at the grippers 25 by spray means 30 mounted on a containment structure 32 mounted on support members or end plugs 34. The end plugs 34 cooperate with the containment structure 32 to define an interior space containing the grippers 25. Means are preferably provided to enable continuous removal of fluid from the containment structure 32 during cleaning. Fluid is supplied to the spray means 30 by a supply line communicating with a fluid reservoir 36.

The cleaning fluid is preferably a liquid comprising a lubricant and a carrier. During spraying, the cleaning fluid removes deposits from the grippers 25 and gripper bars 22, 24. After spraying, a small quantity of cleaning fluid remains on the grippers 25 and gripper bars 22, 24. The carrier subsequently evaporates, leaving only a thin film of lubricant on the cleaned gripper assembly 20. Thus, cleaning and lubricating can be accomplished in a single, neat operation.

Referring particularly to FIG. 1, the preferred system includes a positive displacement pump 38 for pumping fluid from the reservoir to the spray means 30 through a supply line 42, and a second pump 40 for removing fluid from the containment structure through a drain line 44. To enable air to be blown over the grippers 25 before and/or after spraying, a high pressure air line 46 is connected to the supply line between the positive displacement pump and the spray means 30 at a three-way connection 48. Check valves 50 and 52 are provided on the air line 46 and the supply line 42 upstream of the three-way connection 48 to prevent backflow of air into the positive displacement pump 38 and to prevent backflow of fluid into the air line 46.

In the preferred embodiment of the invention, the reservoir 36 is sufficiently large to enable particulate matter to settle out of the fluid during the cleaning operation. This permits the fluid to be continuously recycled during cleaning.

The reservoir 36 preferably has an upper compartment 54 and a detachable lower compartment 56 separated by a valve 58. The valve 58 is normally left open to permit particulate matter to settle into the lower compartment 56. After a long period of use, particulate matter will fill the lower compartment 56. At this point, the valve 58 may be closed and the lower compartment 56 removed to permit disposal of the particulate matter.

The preferred containment structure 32 comprises a bottom portion 60 and a detachable top portion or lid 62. The bottom portion 60 comprises a pair of end walls 64, each having a generally C-shaped arcuate surface 66 for engaging a respective end plug 34, and a longitudinal wall 68 which extends between the end walls 64. The lid 62 similarly comprises a pair of end walls 70 having arcuate sealing surfaces 72 for engagement with the respective end plugs 34 and a longitudinal wall 74 extending therebetween. The lid 62 is detachably secured on the bottom portion 60 by suitable latches 76. The latches 76 preferably maintain pressure to seal the lid 62 to the bottom portion 60.

A sump 78 is disposed on the bottom portion 60 to collect fluid. The sump 78 is defined by a pair of spaced transverse sidewalls 80 projecting downward from opposite sides of a rectangular opening 82 in the bottom portion 60, and a bottom wall 84 extending between the sidewalls 80.

The longitudinal wall 74 of the lid 62 is sealed to that of the bottom portion 60 of the containment structure 32 by mating V-shaped surfaces 86 and 88 extending the length of each of the respective walls 74 and 68. In the illustrated embodiment, the bottom portion 60 includes a pair of generally planar, downwardly extending sealing flanges 90 for sealing against similarly disposed sealing flanges 92 on the lid 62. The sealing flanges 92 on the lid 62 are slightly wider than those on the bottom portion 60 of the containment structure 32 so as to extend further inward with respect to the interior of the containment structure 32. This minimizes exposure of the interfaces between the flanges 90, 92 to spray deflected from the gripper assembly 20, which minimizes leakage through the interfaces.

Each of the end walls 64 of the bottom portion 60 has a pair of generally planar surfaces 94 thereon for sealing against generally planar sealing surfaces 96 on a respective end wall 70 of the lid 62. The surfaces 94 on the end walls 64 of the bottom member 60 are not parallel, but rather define an included angle with respect to one another of about 10°. The surfaces 96 on the end walls 70 of the lid 62 are similarly oriented with respect to one another, so that a wedge action is provided to seal the containment structure 32 at the end walls 64, 70.

It is desirable that the containment structure 32 be relatively compact as clearances around the gripper assembly 20 may be relatively low. A countervailing consideration is that effective spraying requires a certain minimum distance to be maintained between the spray means 30 and the gripper assembly 20. To accommodate both of these considerations, the containment structure 32 in the preferred embodiment has a teardrop-shaped profile. The teardrop shape includes a portion 98 having a relatively large radius of curvature, herein, about 3 inches, and a pair of generally planar portions 100 converging at a portion 102 curved at a relatively small radius. The spray means 30 is located at a radius of about 4 inches from the gripper assembly 20.

The preferred containment structure 32 is made of aluminum, and may be fabricated from sheet metal or from extrusions.

When the lid 62 is in place on the bottom 60 of the containment structure 32, the arcuate sealing surfaces 66 and 72 on the respective end walls 64 and 70 cooperate to define a cylindrical surface at each end engaging a cylindrical peripheral surface 104 on a respective end plug 34. To enable stable mounting of the containment structure 32 on the end plugs 34, and to improve sealing, each end plug 34 has a circular flange 106 on each side of the peripheral surface to define a peripheral channel for engaging the associated end walls 64 and 70.

The end plugs 34 are mounted on the gripper bars 22 and 24, with the gripper bars extending through circular openings 106, 108 in the plugs 34. The plugs 34 herein are made of a flexible material such as a suitable elastomer. A cut 110 extends radially inward from the periphery of the plug 34 to split the openings 106, 108 to enable the plug 34 to be moved between an open position for movement of gripper bars 22 and 24 into or out of the openings 106, 108, and a closed position for sealing engagement with the gripper bars 22, 24. Locking means 112 span the cut 110 to enable the plugs 34 to be locked in closed position on the gripper bars 22, 24. End plugs 34 may be custom made for a particular gripper assembly and a single containment structure 32 may be used on a plurality of different gripper assemblies, using a different pair of end plugs 34 for each.

The preferred spray means 30 comprises a plenum 114 extending generally longitudinally of the containment structure 32, and a plurality of nozzles 116 disposed at spaced intervals along the plenum 114. The plenum 114 is preferably located within the containment structure 32 so that only a single opening in the containment structure 32 is needed for inflow of fluid. The plenum 114 is connected to the supply line 42 by a short pipe segment 118 extending from the plenum 114 through the wall 68.

A drain pipe 120 extends from the sump 78 generally upwardly through the interior of the containment structure 32 and through the wall 68 adjacent the pipe segment 118. Both the drain pipe 120 and the pipe segment 118 have quick-disconnect couplings 122,124 on their ends outside of the containment structure 32 for convenient connection and disconnection to their associated hoses. To aid in controlling leakage, the openings 126, 128 in the containment structure 32 for the drain pipe 120 and pipe segment 118 are preferably disposed on an upper surface of the bottom 60 of the containment structure 32.

In the preferred method of using the apparatus of the invention, the first step is to attach the support members or end plugs 34 to the bars 22 and 24 by flexing them to open position and placing them on the bars 22 and 24 so that the bars 22 and 24 are received within the circular apertures 106 and 108. Once in place, the plugs 34 may be locked in closed position.

Once both plugs 34 have been installed, the bottom 60 and lid 62 of the containment structure 32 are installed on the plugs 34, and latched together. The drain pump 40 and spray pump 38 are then started. The spray pump 38 provides high pressure in the plenum 114 so that the fluid sprays from the nozzles 116 onto the gripper assembly 20. After striking the gripper assembly 20, the fluid collects in the sump 78. The drain pump 40 maintains pressure within the containment structure 32 below atmospheric pressure to minimize leakage, and removes fluid from the sump 78.

During the spraying operation, the containment structure 32 is rotated about an axis parallel to the gripper bars 22 to vary the angle of impingement of the spray on the gripper assembly 20. During such rotation, the plugs 34 remain stationary. The locks 112 on the plugs 34 prevent the rotation from causing the cuts 110 to open and permit leakage. It is generally desirable to limit rotation of the containment structure 32 to an arc of about 60° so that the nozzles 116 are never submerged, which diminishes their cleaning capacity, and the sump 78 is located generally at the bottom of the containment structure 32 so that fluid accumulates therein for removal by the drain pump 40.

After the grippers 25 and bars 22, 24 have been cleaned for a sufficient length of time, the spray pump 38 is turned off and air is blown over the gripper assembly 20 to remove excess fluid therefrom and to evaporate the carrier. Air flows through the spray nozzles 116 into the interior of the containment structure 32, out through the drain pipe 120 and drain hose 44, through the drain pump 40, into the fluid reservoir 36, and out of the fluid reservoir 36 through a steel wool stack which filters the air before it is released to the atmosphere. The air flow is preferably pulsed, which provides greater efficiency in removing residual liquid from the grippers as compared with steady air flow.

From the foregoing it will be appreciated that the invention provides a novel and improved method and apparatus for cleaning gripper assemblies. The invention is not limited to the embodiment described herein nor to any other particular embodiments.

What is claimed is:

1. Cleaning apparatus for removing material from a gripper assembly of the type including a pair of gripper bars and a plurality of movable grippers on a printing press, said cleaning apparatus comprising:

means for effecting relative motion between a fluid said gripper assembly to remove said material from said gripper assembly; and a portable containment structure for forming an enclosure about said grippers on said press to confine said material during and after removal of said material from said gripper assembly;

said portable containment structure including support means to enable temporary mounting of said structure on said printing press, said support means comprising a pair of end members, each end member having a pair of openings therein for receiving said pair of gripper bars.

2. Cleaning apparatus in accordance with claim 1 further comprising means to reduce pressure within said containment structure below atmospheric pressure.

3. Cleaning apparatus in accordance with claim 1 wherein said means for effecting relative motion between a fluid and said gripper assembly comprises at least one spray nozzle and means for pumping said fluid therethrough.

4. Apparatus in accordance with claim 1 wherein said containment structure has a teardrop-shaped profile.

5. Cleaning apparatus for cleaning a gripper assembly of the type which includes a pair of gripper bars and a plurality of grippers, said cleaning apparatus comprising:

a pair of elastomeric support members, each having a pair of openings therein for receiving said gripper bars;

a containment structure supported for rotation on said support members about an axis generally parallel to said gripper bars, said containment structure comprising two members which are movable relative to one another, said members being detachable from one another and from said elastomeric support members; and nozzle means mounted within said containment structure for directing fluid at said gripper assembly for cleaning purposes.

6. Cleaning apparatus in accordance with claim 5 further comprising vacuum means for withdrawing fluid from said containment structure.

7. Cleaning apparatus in accordance with claim 6 wherein said containment structure includes a sump for collection of fluid, and wherein said vacuum means includes a tube having an inlet end disposed within said sump.

8. Cleaning apparatus in accordance with claim 5 wherein each of said elastomeric support members has a cut therein so that each said member may be elastically deformed between an open position sealingly engaging said gripper bars.

9. A method of cleaning a gripper assembly of the type including a plurality of grippers mounted on a printing press, said method comprising the steps of:

placing a portable containment structure in contact with said printing press to define an enclosure about said grippers;

effecting relative motion between a fluid within said containment structure and said grippers and removing said portable containment structure from said printing press.

10. A method in accordance with claim 9 wherein said fluid is air.

11. A method in accordance with claim 9 wherein said fluid is a liquid.

12. A method of cleaning a gripper assembly of the type including a plurality of grippers mounted on a pair of substantially parallel bars, said method comprising the steps of:

placing first and second support members on said bars;

attaching spray means and containment means to said support members so that said spray means and containment means are rotatably supported on said support members;

spraying fluid through said spray means on to said grippers; and rotating said spray means and containment means with respect to said support members to vary the effect of said on said grippers.

* * * * *

UNITED STATES PATENT AND TRADEMARK OFFICE

CERTIFICATE OF CORRECTION

PATENT NO. : 4,699,668

DATED : October 13, 1987

INVENTOR(S) : William P. Burns, Jr. et al.

It is certified that error appears in the above-identified patent and that said Letters Patent is hereby corrected as shown below:

Column 6, line 1, after "fluid" insert --and--.

Column 6, line 53, after "position" insert --enabling installation on and removal from said gripper bars, and a closed position--.

Column 6, line 62, after "grippers" insert --;--.

Column 8, line 7, after "said"(first occurrence) insert --spray--.

Signed and Sealed this

Eighth Day of March, 1988

*Attest:*

DONALD J. QUIGG

*Attesting Officer*

*Commissioner of Patents and Trademarks*